US011469536B2

(12) United States Patent
Ogishita

(10) Patent No.: US 11,469,536 B2
(45) Date of Patent: Oct. 11, 2022

(54) SHAPE OF CONNECTOR SHELLS OF CABLES

(71) Applicant: Sony Interactive Entertainment Inc., Tokyo (JP)

(72) Inventor: Naoki Ogishita, San Mateo, CA (US)

(73) Assignee: Sony Interactive Entertainment Inc., Tokyo (JP)

( * ) Notice: Subject to any disclaimer, the term of this patent is extended or adjusted under 35 U.S.C. 154(b) by 8 days.

(21) Appl. No.: 16/837,880

(22) Filed: Apr. 1, 2020

(65) Prior Publication Data

US 2021/0313732 A1 Oct. 7, 2021

(51) Int. Cl.
*H01R 13/64* (2006.01)
*H01R 13/50* (2006.01)

(52) U.S. Cl.
CPC ..... *H01R 13/50* (2013.01)

(58) Field of Classification Search
CPC ..... H01R 13/50
USPC ..... 439/660
See application file for complete search history.

(56) References Cited

U.S. PATENT DOCUMENTS 5,061,208 A * 10/1991 Bixler ..... H01R 13/648 439/607.47
6,530,793 B2 * 3/2003 Eichhorn ..... H01R 29/00 439/218
D512,381 S 12/2005 Sirichai et al.
D520,457 S 5/2006 Wada et al.
D588,546 S 3/2009 Lee et al.
7,748,986 B1 * 7/2010 Parnapy ..... B60T 17/228 439/34
7,927,140 B2 * 4/2011 Beck ..... H01R 13/5845 439/606
7,938,688 B2 * 5/2011 Teramoto ..... H01R 13/64 439/660
10,256,585 B1 * 4/2019 Wierenga ..... H01R 31/06
2005/0042930 A1 * 2/2005 Harkabi ..... H01R 27/00 439/660
2006/0160377 A1 7/2006 Huang
2008/0096437 A1 * 4/2008 Kuo ..... H01R 13/6594 439/701
2008/0232060 A1 * 9/2008 Yu ..... H05K 5/0278 361/731
2009/0075525 A1 * 3/2009 Gaidosch ..... H01R 13/5812 439/701
2010/0029167 A1 * 2/2010 Leung ..... G06F 21/79 446/72
2010/0267282 A1 * 10/2010 Tsai ..... H01R 24/60 439/607.17
2010/0311283 A1 * 12/2010 Desrosiers ..... H01R 13/639 439/680
2011/0034083 A1 2/2011 Ko et al.
(Continued)

OTHER PUBLICATIONS

"International Search Report and Written Opinion" dated Jul. 8, 2021, from the counterpart PCT application PCT/US21/025344.

*Primary Examiner* — Abdullah A Riyami
*Assistant Examiner* — Nelson R. Burgos-Guntin
(74) *Attorney, Agent, or Firm* — John L. Rogitz

(57) ABSTRACT

An assembly includes an electrical cord, an electrical connector, and a housing having a first end engaged with the electrical cord and a second end from which the electrical connector extends. The first end has a first transverse cross-section and the second end has a second transverse cross-section different from the first transverse cross-section.

21 Claims, 5 Drawing Sheets

(56) References Cited

U.S. PATENT DOCUMENTS

| | | | | |
|---|---|---|---|---|
| 2011/0237094 | A1* | 9/2011 | Takagi | H01R 13/6594 439/55 |
| 2011/0281470 | A1* | 11/2011 | Su | H01R 13/648 439/660 |
| 2012/0077369 | A1* | 3/2012 | Andersen | H01R 13/642 439/488 |
| 2012/0147544 | A1* | 6/2012 | Mao | H05K 5/0278 361/679.31 |
| 2013/0169891 | A1* | 7/2013 | Hirashima | H04N 5/64 348/836 |
| 2014/0098483 | A1* | 4/2014 | Miller | H05K 1/00 361/679.32 |
| 2014/0273546 | A1* | 9/2014 | Harmon | H01R 13/6205 439/39 |
| 2015/0043138 | A1* | 2/2015 | Itoh | H04R 1/02 361/679.3 |
| 2015/0295364 | A1* | 10/2015 | Ueda | H01R 13/7031 439/607.34 |
| 2015/0325962 | A1* | 11/2015 | Byrne | H01R 13/743 439/529 |
| 2016/0071664 | A1* | 3/2016 | Cohen | H01H 13/705 200/341 |
| 2016/0099521 | A1* | 4/2016 | Gzybowski | H01R 31/06 439/489 |
| 2016/0218239 | A1* | 7/2016 | Gubser | H01L 24/97 |
| 2017/0172003 | A1* | 6/2017 | Susini | G06F 1/266 |
| 2017/0229803 | A1* | 8/2017 | Putnam | H01R 24/64 |
| 2020/0044396 | A1* | 2/2020 | Ito | H01R 13/6594 |
| 2020/0287404 | A1* | 9/2020 | Zhijian | H02J 7/0042 |

* cited by examiner

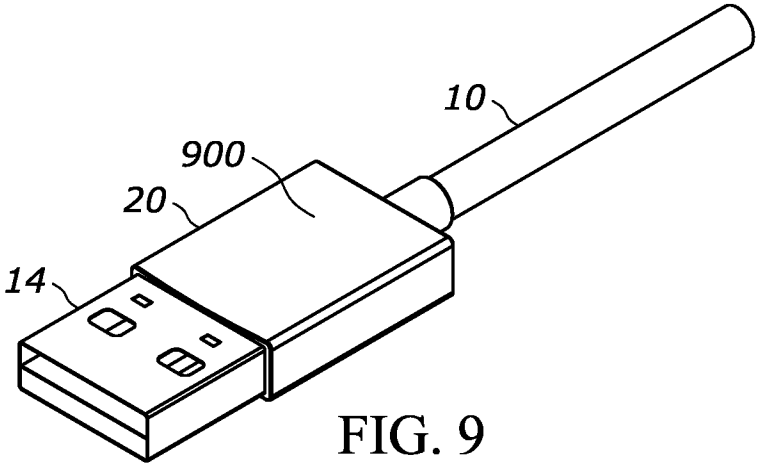
FIG. 9
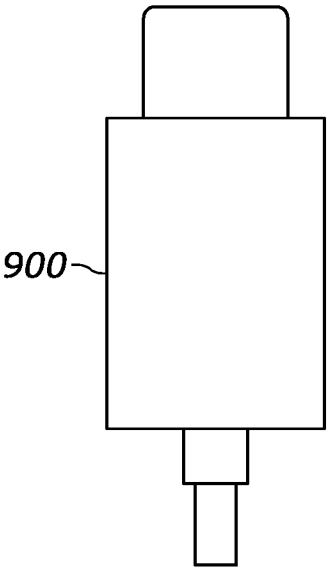
FIG. 10A
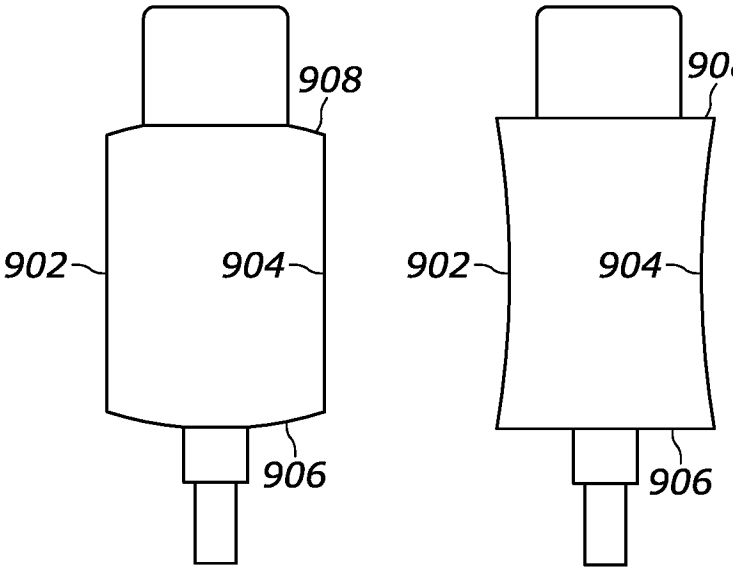
FIG. 10B
FIG. 10C
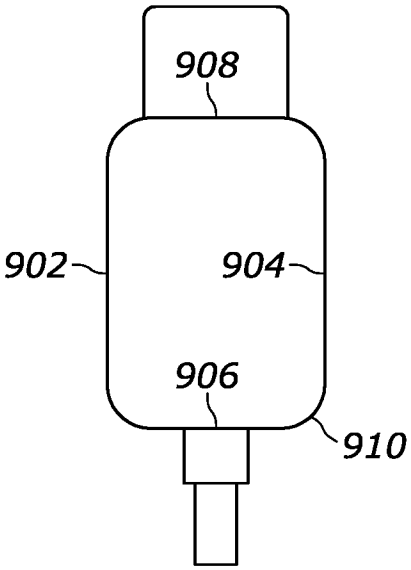
FIG. 10D

SHAPE OF CONNECTOR SHELLS OF CABLES

FIELD

The application relates generally to shapes of connector shells for cables.

BACKGROUND

Computer cables that terminate in electrical connectors typically have a housing supporting the connector that can be grasped by hand to plug and unplug the connector. As understood herein, under some circumstances such as low lighting or tight quarters in which a person cannot easily see where the connector is to be plugged in, it may be difficult for the person to immediately ascertain the orientation of the connector with respect to the plug sought to be engaged.

SUMMARY

Accordingly, an assembly includes an electrical cord, an electrical connector, and a housing having a first end engaged with the electrical cord and a second end from which the electrical connector extends. The first end has a rectilinear transverse cross-section and the second end has a concave transverse cross-section.

In example embodiments of this first aspect, the second end includes left and right edges and top and bottom edges extending from the left edge to the right edge. At least the top edge is continuously curved and may have a constant radius of curvature. The bottom edge may be a mirror image of the top edge.

In another example, the second end includes left and right edges and top and bottom edges extending from the left edge to the right edge. At least the top edge includes a first straight segment extending obliquely from the left edge to a center point and a second straight segment extending obliquely from the center point to the right edge. The bottom edge may be a mirror image of the top edge.

In another example, the second end includes left and right edges and top and bottom edges extending from the left edge to the right edge. At least the top edge includes a first segment extending obliquely from the left edge, a second segment extending from the first segment and being perpendicular to the left and right edges, and a third segment extending obliquely from the second segment to the right edge. The bottom edge may be a mirror image of the top edge.

In another example, the second end includes left and right edges and top and bottom edges extending from the left edge to the right edge. At least the top edge is continuously curved with a variable radius of curvature. The bottom edge may be a mirror image of the top edge.

In another example, the second end includes left and right edges and top and bottom edges extending from the left edge to the right edge. At least the top edge includes a first segment extending from the left edge perpendicularly to the left and right edges, a second concave segment extending from the first segment, and a third segment extending from the second segment to the right edge perpendicularly to the left and right edges. The bottom edge may be a mirror image of the top edge.

In another example, the second end includes left and right edges and top and bottom edges extending from the left edge to the right edge. At least the top edge includes a concave segment extending from the left edge to the right edge and having a roughened surface comprising plural saliences. The bottom edge may be a mirror image of the top edge.

The second end may be smaller than the first end.

In another aspect, an assembly includes a cord, a connector, and a housing having a first end engaged with the cord and a second end from which the connector extends. The first end has a first transverse cross-section and the second end has a second transverse cross-section different from the first transverse cross-section.

One of the ends may have a concave transverse cross-section and the other end may have a rectilinear transverse cross-section. One of the ends may include a convex transverse cross-section. One of the ends may be smaller than another of the ends.

In another aspect, a kit includes first and second connector assemblies, each comprising a respective cord and a respective housing and respective connector extending from the respective housing. The respective housing of the first connector assembly has a concave transverse cross-section and the shape of the respective housing of the second connector assembly is substantially the same as the shape of the respective housing of the first assembly.

The details of the present application, both as to its structure and operation, can best be understood in reference to the accompanying drawings, in which like reference numerals refer to like parts, and in which:

BRIEF DESCRIPTION OF THE DRAWINGS

FIG. 9 is a perspective view showing an example top surface of an example connector shell or cable; and FIGS. 10A-10D illustrate example shapes of the top surface shown in FIG. 9.

DETAILED DESCRIPTION

Figure 1:
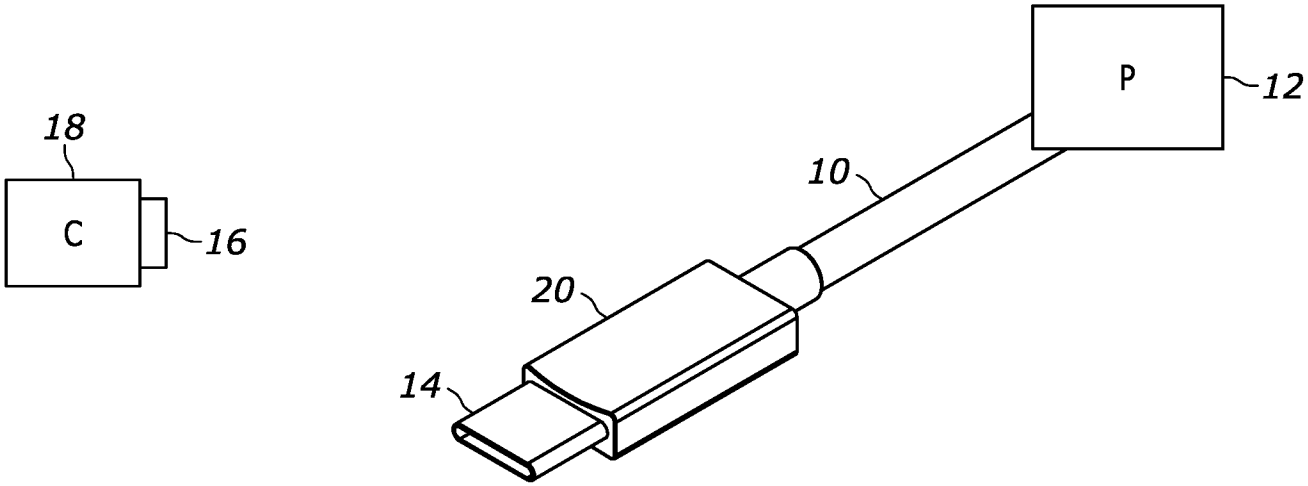
FIG. 1 is a perspective view of an example connector shell, also referred to herein as a "housing", in one example environment.

FIG. 1 shows an assembly that includes an electrical cord 10 extending from electrical components in, for example, computer peripheral 12 such as a printer, display, input device, video source, etc. and electrically connected to a connector 14 that may be plugged in to receptacle 16 of a computer device 18 such as a personal computer, video sink, etc. A housing 20 supports the cable 10 and connector 14 and various features of the housing 20 are described further below. The housing 20 may be metal or plastic and may be generally hollow.

In non-limiting examples the cord 10 may comprise a cord, more than one connector, and more than one housing having a first end engaged with a cord and a second end from which the connector extends respectively, such as an electric cable which has a USB-A connector and a USB-C connector at the edges of the cord respectively, or an electric cable which has two HDMI connectors at the edges of the cord.

Figure 2:
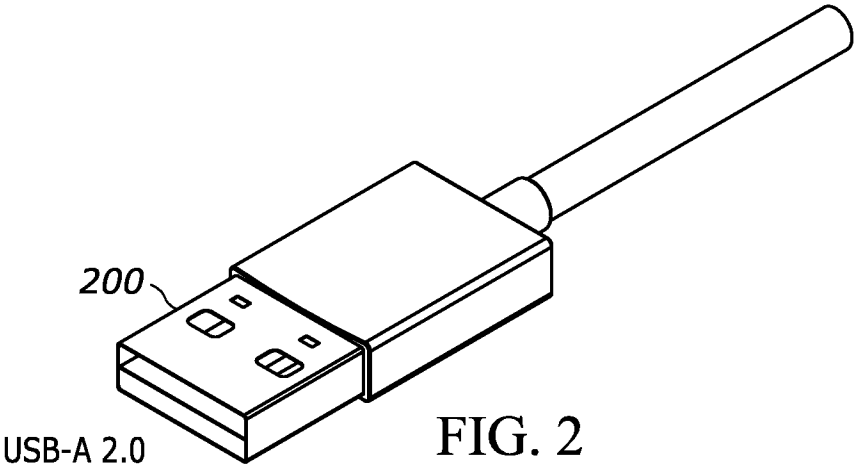
FIG. 2 is a perspective view of another example type of connector.
Figure 4:
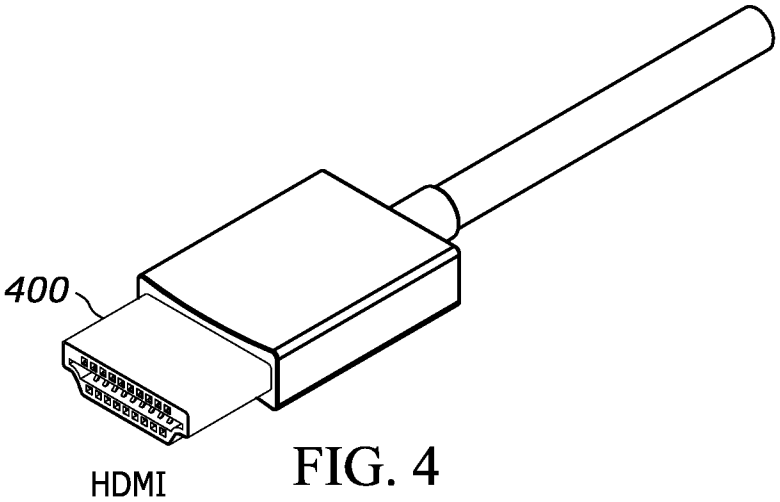
FIG. 4 is a perspective view of another example type of connector.
Figure 3:
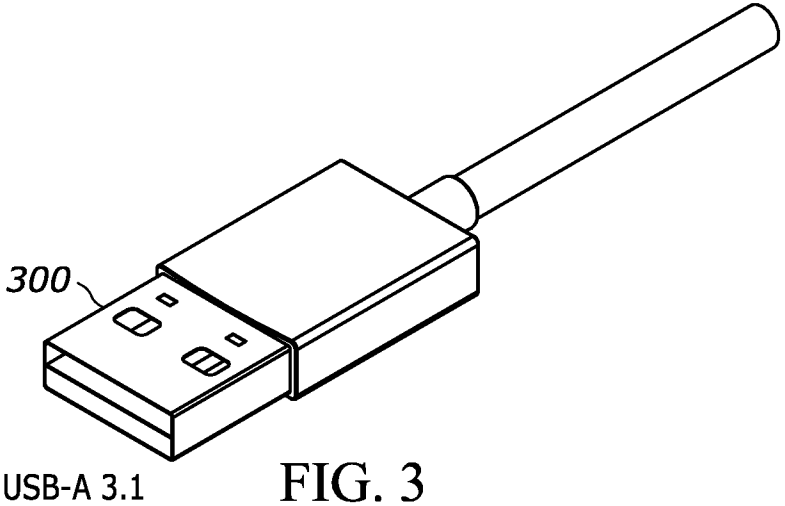
FIG. 3 is a perspective view of another example type of connector.

FIG. 1 illustrates a connector 14 configured as a universal serial bus (USB)-C 2.0 connector. FIG. 2 illustrates a connector 200 that is configured as a USB-A 2.0 connector. FIG. 3 illustrates a connector 300 that may be configured as a USB-A 3.1 connector. FIG. 4 illustrates a connector 400 that may be configured as a high definition multimedia interface (HDMI) connector. These are but example types of connectors that may be used consistent with present principles, all being connected to respective cables by respective housings consistent with present principles.

Figure 5:
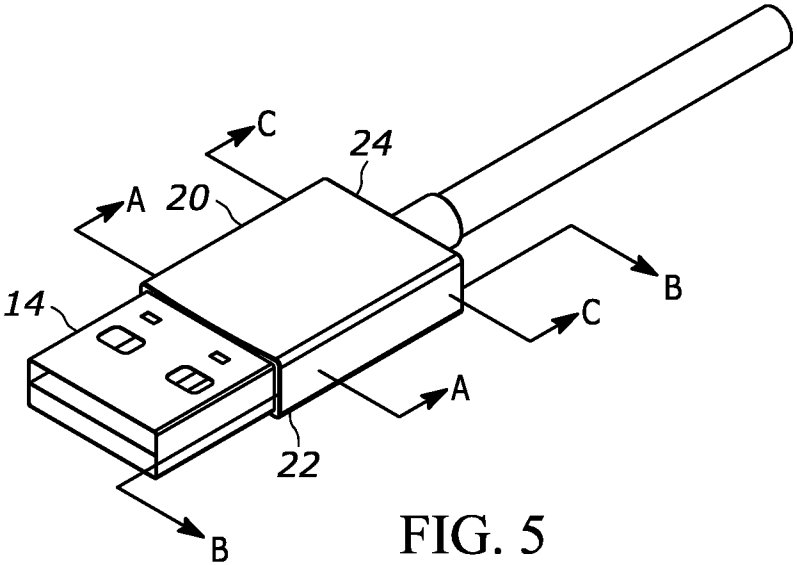
FIG. 5 is a perspective view of an example connector shell or housing illustrating various cross-section locations.

FIG. 5 illustrates the housing 20 and shows that a first end 22 which may be the end from which the connector 14 projects has a transverse cross-section taken along the line A-A. The housing 20 may have a longitudinal cross-section taken along the line B-B. FIG. 5 also illustrates that the housing 20 has a second end 24 which may be the end from which the cord 10 extends and has a transverse cross-section taken along the line C-C.

FIGS. 6A-6F illustrate various concave-type cross sections that the first end 22 may have, it being understood that the cross-sections of the ends 22, 24 may be reversed from those shown, i.e., that the second end may assume any of the cross-sections shown for the first end and the first end may assume any of the cross-sections shown for the second end.

Figure 6A:
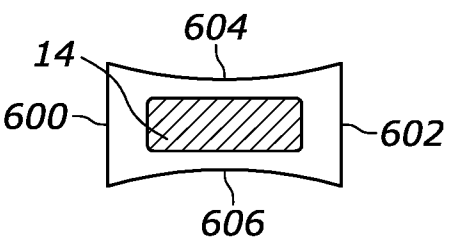
FIGS. 6A-6F are example embodiments of respective transverse cross-sections at a first end (in the examples shown, the connector end) as would be seen along the line A-A in FIG. 5.

In FIG. 6A, the first end 22 has a concave transverse cross-section. Specifically, the first end includes left and right edges 600, 602 that may be straight and parallel to each other and top and bottom edges 604, 606 extending from the top of the left edge 600 to the top of the right edge 602. At least the top edge 604 is continuously curved inwardly, i.e., toward the geometric center of the housing as shown, and in the example shown may have a constant radius of curvature. The bottom edge 606 may be a mirror image of the top edge 604.

Figure 6B:
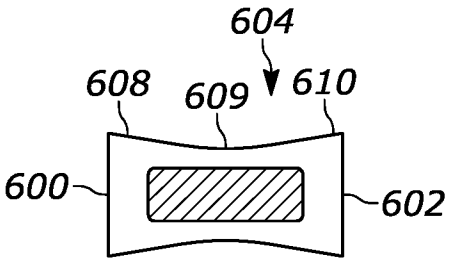

In the example of FIG. 6B, at least the top edge 604 may include a first straight segment 608 extending obliquely (i.e., oblique to the plane defined by the left and right edges 600, 602) inwardly from the top of the left edge 600 to a center point 609 and a second straight segment 610 extending obliquely outwardly from the center point to the top of the right edge 602. The bottom edge may be a mirror image of the top edge.

Figure 6C:
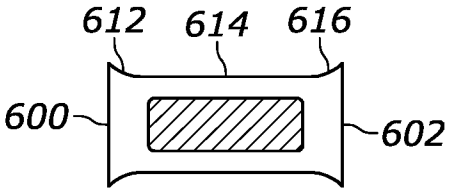

In the example of FIG. 6C, the top edge includes a first segment 62 extending obliquely from the top of the left edge 600, a second segment 614 extending from the first segment 612 and being perpendicular to the left and right edges 600, 602, and a third segment 616 extending obliquely from the second segment 612 to the top of the right edge 602. The bottom edge may be a mirror image of the top edge.

Figure 6D:
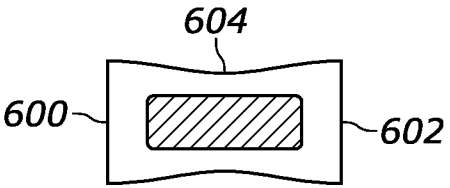

In the example of FIG. 6D, the top edge 604 is continuously curved inwardly from the top of the left edge 600 to the top of the right edge 602 with a variable radius of curvature. In the example shown, the radius of curvature of the top edge 604 is less nearer the edges and greater neared the center point. The bottom edge may be a mirror image of the top edge. It is to be appreciated that both ends may have concave transverse cross-sectional radii of curvatures that are different from each other, e.g., one radius of curvature may be greater than the other, one radius of curvature may be variable and the other constant, etc.

Figure 6E:
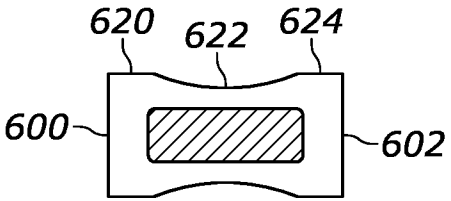

In the example of FIG. 6E, the top edge includes a first segment 620 extending from the top of the left edge 600 perpendicularly to the left and right edges 600, 602, a second concave segment 622 extending from the first segment 620, and a third segment 624 extending from the second segment to the top of the right edge perpendicularly to the left and right edges 600, 602. The bottom edge may be a mirror image of the top edge.

Figure 6F:
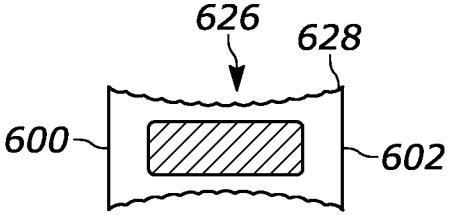

In the example shown in FIG. 6F, the top edge includes a concave segment 626 extending from the top of the left edge 600 to the top of the right edge 602 and having a roughened surface comprising plural saliences 628 such as small bumps or small spike-like structures. The bottom edge may be a mirror image of the top edge.

Figure 7A:
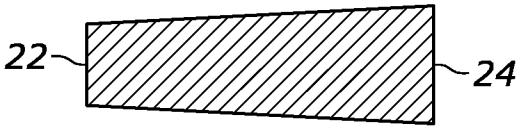
FIGS. 7A-7E are example embodiments of respective longitudinal cross-sections as would be seen along the line B-B in FIG. 5.
Figure 7B:
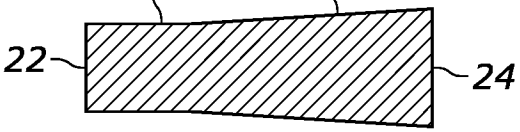

FIG. 7A shows that the housing 20 may have a longitudinal cross section that is trapezoidal shaped from a smaller first end 22 to the second, larger end 24. FIG. 7B illustrates that the housing 20 may have a longitudinal cross section that has a rectilinear segment 700 extending from the first end 22 merging with a trapezoidal-shaped segment 702 extending from the rectilinear segment 700 to the second, larger end 24.

Figure 7C:
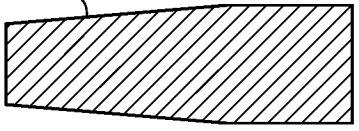

FIG. 7C illustrates that the housing 20 may have a longitudinal cross section that has a generally trapezoidal segment 704 that may be gently convex from the first end 22 to the second end 24.

Figure 7D:
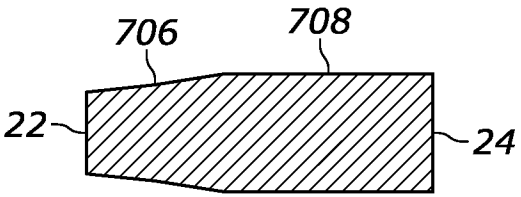
Figure 7E:
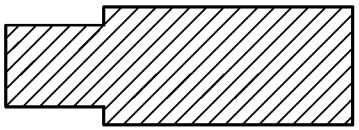

FIG. 7D illustrates that the housing 20 may have a longitudinal cross section that has a trapezoidal segment 706 extending from the first end 22 merging with a rectilinear segment 708 extending from the trapezoidal segment 706 to the second, larger end 24. FIG. 7E illustrates a stepped longitudinal cross-section.

Figure 8A:
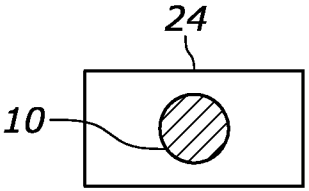
FIGS. 8A-8C are example embodiments of respective transverse cross-sections at a second end (in the examples shown, the cable end) as would be seen along the line C-C in FIG. 5.
Figure 8B:
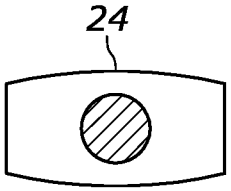
Figure 8C:
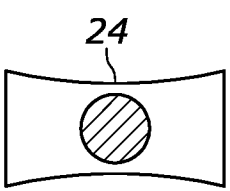

FIGS. 8A-8C illustrates that the second end 24 may respectively have a rectilinear transverse cross-section, a convex transverse cross-section, or a concave transverse cross-section.

FIG. 9 illustrates that the housing 20 may have a top surface 900. FIGS. 10A-10D illustrate various shapes the edges of the top surface 900 may form.

In FIG. 10A, the top surface is rectilinear.

In FIG. 10B, the left and right edges 902, 904 of the top surface are straight and parallel to each other, whereas the opposed ends 906, 908 at which the left and right edges 902, 904 terminate are convex.

In FIG. 10C, the left and right edges 902, 904 of the top surface are concave, whereas the opposed ends 906, 908 at which the left and right edges 902, 904 terminate are straight and parallel to each other.

In FIG. 10D, beveled corners 910 are formed at the junctions of the edges 902, 904 and ends 906, 908.

The various shapes herein facilitate easier gripping of the connector housing and also provide tactile indication of the orientation of the housing.

Plural assemblies each with its own housing shaped according to principles herein may be provided in a kit. The housings of the assemblies may be substantially (e.g., within manufacturing tolerances) identical to each other in shape, and may have the same size or different sizes from each other.

It will be appreciated that whilst present principals have been described with reference to some example embodiments, these are not intended to be limiting, and that various alternative arrangements may be used to implement the subject matter claimed herein.

What is claimed is:

1. An assembly comprising:

an electrical cord;

an electrical connector; and a housing having a first end engaged with the electrical cord and a second end from which the electrical connector extends, the first end having a rectilinear transverse cross-section and the second end having a concave transverse cross-section.

2. The assembly of claim 1, wherein the second end comprises left and right edges and top and bottom edges extending from the left edge to the right edge, at least the top edge being continuously curved.

3. The assembly of claim 1, wherein the second end comprises left and right edges and top and bottom edges extending from the left edge to the right edge, at least the top edge comprising a first straight segment extending obliquely from the left edge to a center point and a second straight segment extending obliquely from the center point to the right edge.

4. The assembly of claim 1, wherein the second end comprises left and right edges and top and bottom edges extending from the left edge to the right edge, at least the top edge comprising a first segment extending obliquely from the left edge, a second segment extending from the first segment and being perpendicular to the left and right edges, and a third segment extending obliquely from the second segment to the right edge.

5. The assembly of claim 1, wherein the second end comprises left and right edges and top and bottom edges extending from the left edge to the right edge, at least the top edge being continuously curved with a variable radius of curvature.

6. The assembly of claim 1, wherein the second end comprises left and right edges and top and bottom edges extending from the left edge to the right edge, at least the top edge comprising a first segment extending from the left edge perpendicularly to the left and right edges, a second concave segment extending from the first segment, and a third segment extending from the second segment to the right edge perpendicularly to the left and right edges.

7. The assembly of claim 1, wherein the second end comprises left and right edges and top and bottom edges extending from the left edge to the right edge, at least the top edge comprising a concave segment extending from the left edge to the right edge and having a roughened surface comprising plural saliences.

8. The assembly of claim 1, wherein the second end is smaller than the first end.

9. An assembly comprising:

a cord;

a connector; and a housing having a first end engaged with the cord and a second end from which the connector extends, the first end having a first transverse cross-section and the second end having a second transverse cross-section different from the first transverse cross-section, at least one of the ends comprising a concave transverse cross-section.

10. The assembly of claim 9, wherein the second end comprises a concave transverse cross-section and the first end comprises a rectilinear transverse cross-section.

11. The assembly of claim 9, wherein the first end comprises a concave transverse cross-section and the second end comprises a rectilinear transverse cross-section.

12. The assembly of claim 9, wherein at least one of the ends comprises a convex transverse cross-section.

13. The assembly of claim 9, wherein one of the ends is smaller than another of the ends.

14. The assembly of claim 9, wherein the cord is a first cord, the connector is a first connector, the housing is a first housing, and the assembly comprises:

a second cord;

a second connector; and a second housing having a first end engaged with the second cord and a second end from which the second connector extends, the second housing having substantially the same shape as the first housing.

15. The assembly of claim 9, wherein the second end comprises left and right edges and top and bottom edges extending from the left edge to the right edge, at least the top edge being continuously curved.

16. The assembly of claim 9, wherein the second end comprises left and right edges and top and bottom edges extending from the left edge to the right edge, at least the top edge comprising a first straight segment extending obliquely from the left edge to a center point and a second straight segment extending obliquely from the center point to the right edge.

17. The assembly of claim 9, wherein the second end comprises left and right edges and top and bottom edges extending from the left edge to the right edge, at least the top edge comprising a first segment extending obliquely from the left edge, a second segment extending from the first segment and being perpendicular to the left and right edges, and a third segment extending obliquely from the second segment to the right edge.

18. The assembly of claim 9, wherein the second end comprises left and right edges and top and bottom edges extending from the left edge to the right edge, at least the top edge being continuously curved with a variable radius of curvature.

19. The assembly of claim 9, wherein the second end comprises left and right edges and top and bottom edges extending from the left edge to the right edge, at least the top edge comprising a first segment extending from the left edge perpendicularly to the left and right edges, a second concave segment extending from the first segment, and a third segment extending from the second segment to the right edge perpendicularly to the left and right edges.

20. The assembly of claim 9, wherein both ends comprise concave transverse cross-sections, the concave transverse-cross section of the first end having a first radius of curvature, the transverse cross-section of the second end having a second radius of curvature different from the first radius of curvature.

21. A kit comprising:

first and second connector assemblies each comprising a respective cord and a respective housing and respective connector extending from the respective housing, the respective housing of the first connector assembly having substantially the same shape as the respective housing of the second connector assembly, the first connector housing having a transverse cross-section that is concave.

* * * * *